US007234172B1

(12) United States Patent
Hoelscher

(10) Patent No.: US 7,234,172 B1
(45) Date of Patent: Jun. 26, 2007

(54) GLOVE WITH SUPPORT FOR HYPER-EXTENSION RESISTANCE

(76) Inventor: Steven L. Hoelscher, 3118 Breckenridge La., Apt. #43, Louisville, KY (US) 40220

( * ) Notice: Subject to any disclaimer, the term of this patent is extended or adjusted under 35 U.S.C. 154(b) by 0 days.

(21) Appl. No.: 11/342,435

(22) Filed: Jan. 30, 2006

(51) Int. Cl.
*A41D 19/00* (2006.01)

(52) U.S. Cl. ..... 2/161.1; 2/163

(58) Field of Classification Search ..... 2/161.1, 2/161.6, 163
See application file for complete search history.

(56) References Cited

U.S. PATENT DOCUMENTS

| | | | | |
|---|---|---|---|---|
| 1,951,190 | A | 3/1934 | Gambee | |
| 3,038,723 | A * | 6/1962 | Bergendorf | 473/61 |
| 3,593,803 | A * | 7/1971 | Ibach | 172/10 |
| 4,706,658 | A | 11/1987 | Cronin | |
| 4,766,612 | A | 8/1988 | Patton, Sr. | |
| 4,796,306 | A * | 1/1989 | Mitchell | 473/205 |
| 5,018,221 | A | 5/1991 | Romandetto | |
| 5,022,094 | A * | 6/1991 | Hames et al. | 2/163 |
| 5,232,436 | A | 8/1993 | Janevski | |
| 5,373,585 | A * | 12/1994 | Wiggins | 2/159 |
| 5,435,013 | A * | 7/1995 | Davis | 2/161.1 |
| 5,453,064 | A | 9/1995 | Williams, Jr. | |
| 5,476,439 | A | 12/1995 | Robinson | |
| 5,487,188 | A * | 1/1996 | Micheloni et al. | 2/16 |
| 5,600,849 | A | 2/1997 | Hu | |
| 5,697,103 | A * | 12/1997 | Wiggins | 2/159 |
| 5,720,047 | A | 2/1998 | Spitzer | |
| 6,010,473 | A | 1/2000 | Robinson | |
| 6,059,694 | A | 5/2000 | Villepigue | |
| 6,526,592 | B1 | 3/2003 | Best | |
| 6,534,057 | B2 | 3/2003 | Allen | |
| 6,557,177 | B2 | 5/2003 | Hochmuth | |
| 6,584,615 | B1 | 7/2003 | Wilder et al. | |
| 6,716,185 | B1 | 4/2004 | Rieger | |
| 6,813,781 | B2 | 11/2004 | Wilder et al. | |
| 6,938,274 | B2 * | 9/2005 | Addington et al. | 2/161.1 |
| 2003/0200593 | A1 | 10/2003 | Chou | |
| 2004/0187190 | A1 | 9/2004 | Wilder et al. | |
| 2005/0091721 | A1 | 5/2005 | Best | |
| 2005/0153153 | A1 | 7/2005 | Saur et al. | |

* cited by examiner

*Primary Examiner*—Katherine Moran
(74) *Attorney, Agent, or Firm*—Carrithers Law Office PLLC; David W. Carrithers

(57) ABSTRACT

A hand glove for the participant of an active sport in which at least one of the participants fingers maybe subjected to hyper-extension from contact received from participating in that sport. The glove has respectively oppositely disposed palm and dorsal faces, a plurality of individual finger elements and an elongate strip of material having at least elastically stretchable portions spaced apart from one another longitudinally along the strip and on the palm face side of the glove for each one of selected finger elements of the glove. Each strip is anchored at one end thereof proximate the tip of the glove finger element associated therewith and at the other end proximate the palm portion of the glove. Each strip being elastically stretchable is tensioned causing the finger element associated therewith to curl in a direction of the fingers for gripping an article.

33 Claims, 6 Drawing Sheets

GLOVE WITH SUPPORT FOR HYPER-EXTENSION RESISTANCE

FIELD OF INVENTION

The present invention relates generally to protective equipment for participants of active sports, such as soccer, and more particularly relates to improvements to gloves directed to reducing the likelihood of finger hyper-extension when participating in the sport. The invention however has other applications such as for example it may also be used for exercising specific finger/hand controlling muscles or other environments where a finger, thumb or wrist maybe bent backward i.e. in a direction opposite to that for grasping an object.

BACKGROUND OF INVENTION

A risk attendant with some sports, for example, a soccer goal keeper is the hyper-extension of finger joints or thumb or wrist injury. It is known to use hinged strips in the finger elements of the glove to reduce the likelihood of finger joint hyper-extension. The hinged strips allow flexing in a gripping direction of the hand but block bending in an opposite direction.

The proposed directional flex strips are complicated and thus expensive items to produce. Also they are bulky occupying considerable finger space. It is also known to provide gloves with specialized padding or cushioning. For further information on various proposals reference maybe had to the following references: U.S. Published application No. US 2005/0153153 A1 Published Jul. 14, 2005; U.S. Pat. No. 6,557,177 granted May 6, 2003; U.S. Pat. No. 5,720,047 granted Feb. 24, 1998 and PCT application WO 01/00052.

As previously mentioned a further use of applicants glove could be that of an exercise device. As an example of one such known unit reference maybe had to U.S. Pat. No. 5,453,064 granted Sep. 26, 1995 and entitled "Exercise Glove Incorporating Rods Which Offer Resistance to Movement of Fingers, Hands or Wrists". Disclosed are flexible elongate "inextensible" strips insertable into pockets in the finger elements of the glove with applicant pointing out that the strips maybe straight or curved.

SUMMARY OF INVENTION

In keeping with the forgoing there is provided in accordance with the present invention a hand glove for the participant of an active sport in which at least one of the participants fingers maybe subjected to hyper-extension while participating in that sport. The glove has respectively oppositely disposed palm and dorsal faces, a palm area, a plurality of individual finger elements projecting from the palm area, and an elongate elasticized strip of material disposed on the palm face side of a hand in the glove for at least selected ones of the individual finger elements of the glove. Each one of the strips being anchored at one end thereof proximate the tip of the glove finger element associated therewith and at the other end proximate or in the palm area of the glove. Each strip is tensioned so as to cause the finger element associated with such strip to curl in a direction of movement for gripping an article.

An object of the present invention is to provide a glove with an elongate elastic or elasticized stretchable strip on one or more finger elements of a glove in which such strip is anchored to the glove and tensioned so as to cause the glove finger element associated therewith to curl in the direction of an article gripping position when the stretchable strip is in an at rest state.

Another object of the present invention is to provide a sports glove with a relatively simple inexpensive means to reduce the likelihood of finger hyper-extension while participating in a sporting activity.

A further object of the present invention is provide a glove of the foregoing wherein the injury preventing means occupies minimal space in the glove.

A further object of the present invention is to provide a glove of the foregoing wherein at least selected ones of the injuring preventing elongate stretchable strips is adjustable permitting varying tension of the same.

A further object of the present invention is to provide a sports glove with finger hyper-extension preventing means that can be readily incorporated into gloves of any size.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein.

DETAILED DESCRIPTION OF PREFERRED EMBODIMENT

Figure 4:
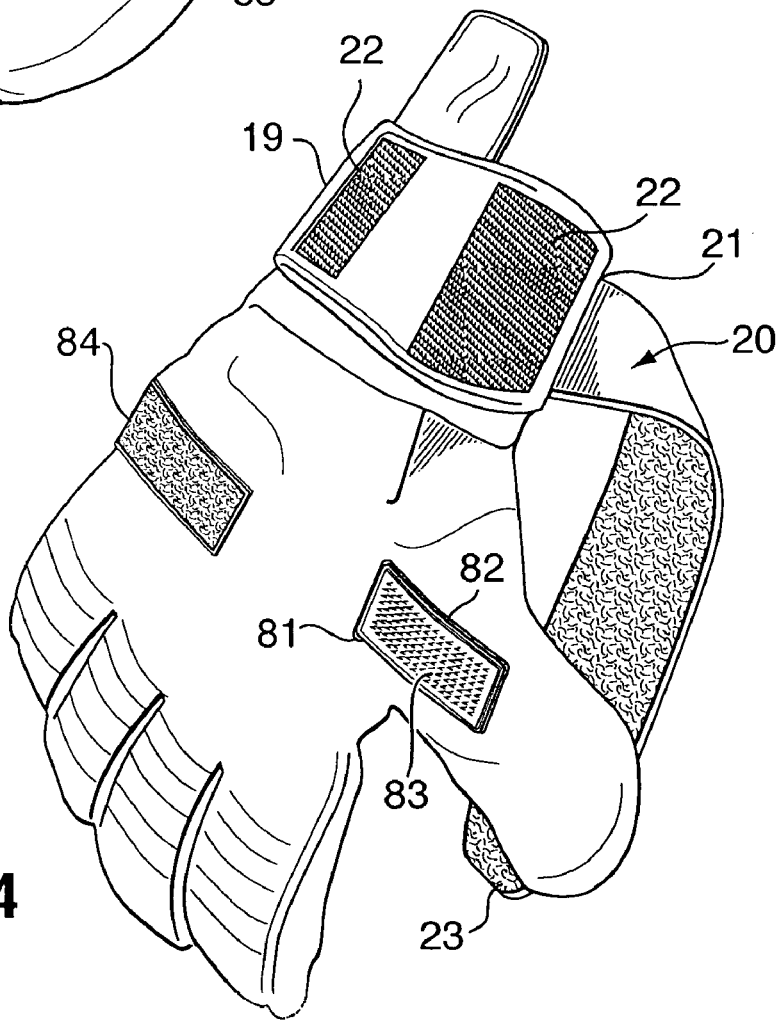
FIG. 4 is similar to FIG. 2 showing the glove with an elasticized thumb support strip.

Referring to the drawings there is illustrated a soccer glove 10 having oppositely disposed faces 11 and 12 commonly known as respective palm and dorsal faces. The glove has a palm portion 13, a thumb element 14 and individual finger elements 15, 16, 17, and 18 projecting from the palm portion. The glove has a wrist band 19 and a wrist strap 20 that is attached at one end thereof, as indicated at 21 (see FIG. 4), to the wrist band and can be tightly wrapped there around and secured thereto by a hook and loop fastener having portions 22, 23 respectively on the wrist band and wrist strap.

A preferred embodiment of the soccer glove 10 of the present invention is provided with elongate stretchable elasticized strips 31, 32, 33 and 34 on the respective finger elements 15, 16. 17 and 18. These strips are secured at opposite ends thereof to the glove in a stretched state so as in an at rest state cause the finger element of the glove associated therewith to curl in the direction of a hand gripping position. The strips maybe a piece of elastically stretchable material (elastic or elasticized) and stretchable throughout the entire length thereof or alternatively have elastically stretchable portions and non-stretchable portions alternating longitudinally along the strip, the latter being applicants preferred embodiment and will be described in further detail hereinafter.

In the embodiment illustrated in the Figures, one end of the strip is secured to the glove proximate the distal end to the glove finger element associated therewith and the opposite end to a portion of the palm of the glove. In an embodiment illustrated in FIGS. 8 and 9 the strip goes around the end the finger and is anchored to the glove at a position facing the finger nail of ones finger in the glove. In that all of the strips and glove finger elements associated therewith are of the same construction only one, for sake of brevity, will be described herein in detail. As will be seen in the drawings and become more apparent hereinafter one end of the strip in one embodiment is secured to the glove in the palm portion thereof (FIGS. 1–7) and in another embodiment to further stretchable elastic strips that permit adjustably varying the tension of the strips (FIGS. 8, 9).

Figure 5:
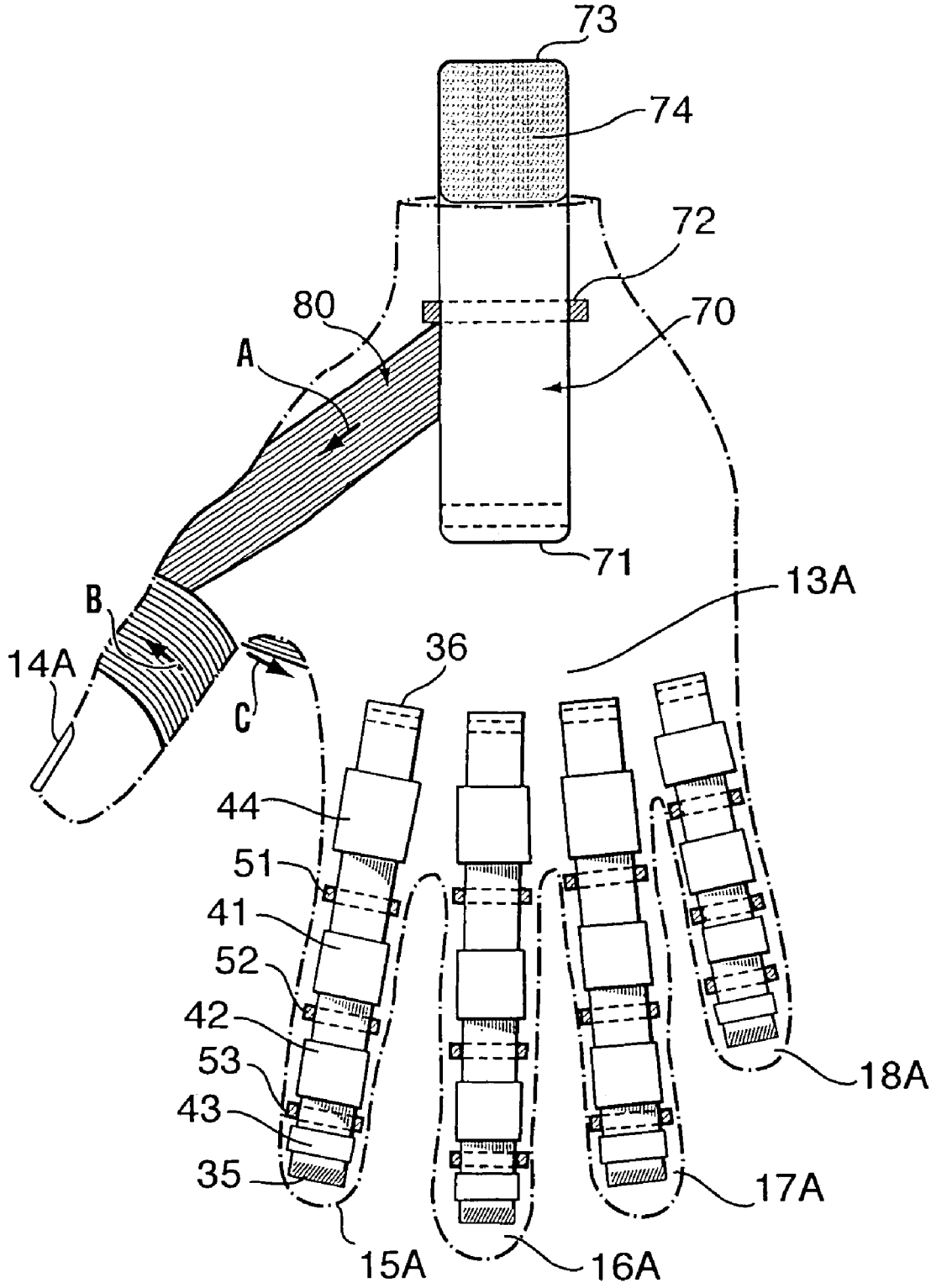
FIG. 5 is a view of the palm face side of a hand with applicants glove elasticized strips superimposed thereon, the glove portion being omitted for clarity of illustration.
Figure 6:
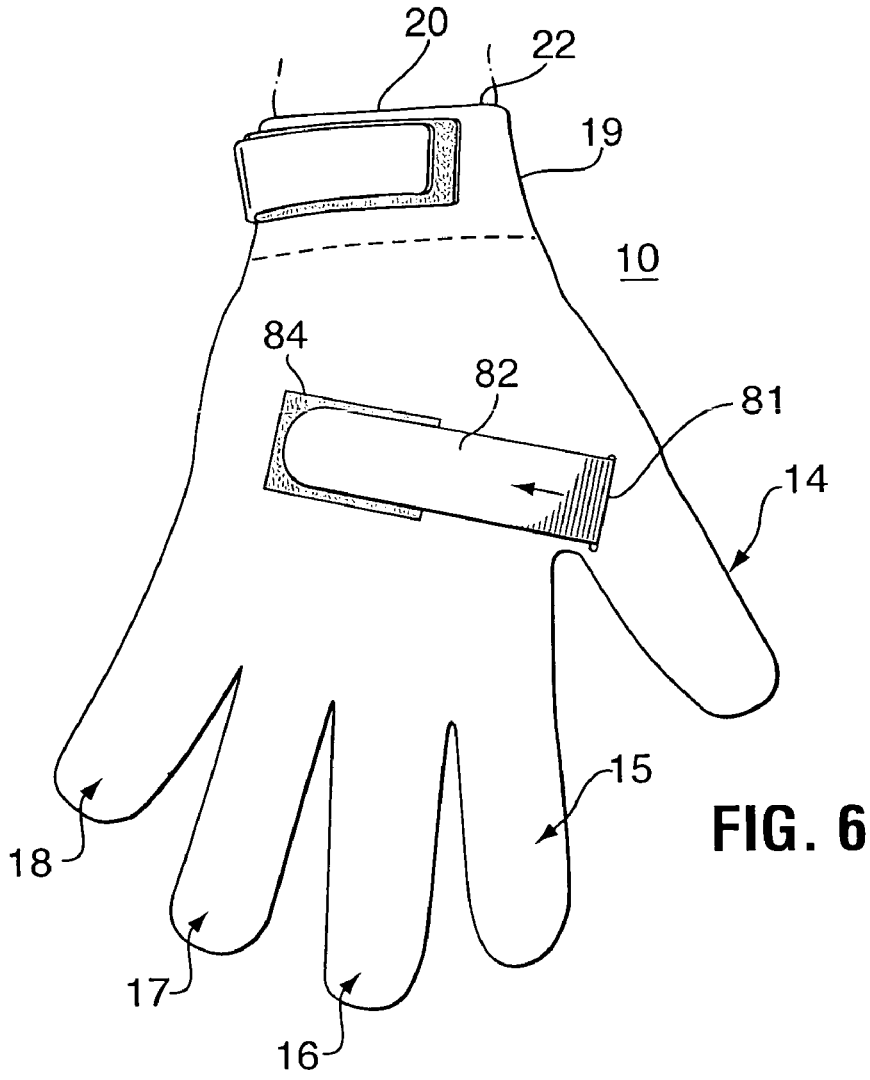
FIG. 6 is a view of the dorsal side of the glove showing the detachable adjustable fastening means for the wrist strap and applicants thumb protecting elasticized strip.
Figure 8:
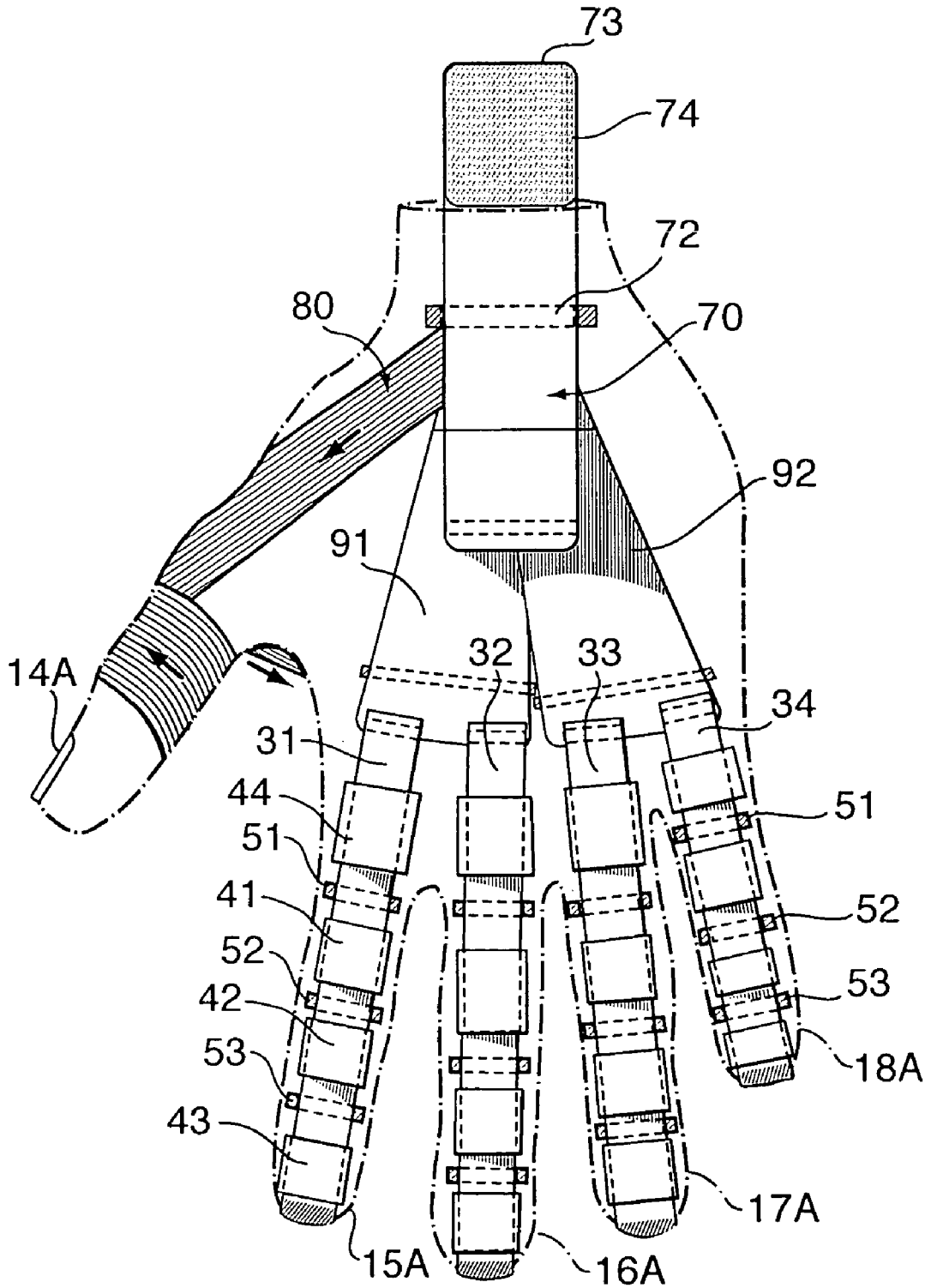
FIG. 8 is a view similar to FIG. 5 but illustrating a modified arrangement of the elasticized strips that protect the various finger and thumb joints and the wrist and as in FIG. 6 the glove has not been illustrated for the sake of clarity of illustration of the protective strips relative to the finger joints.
Figure 9:
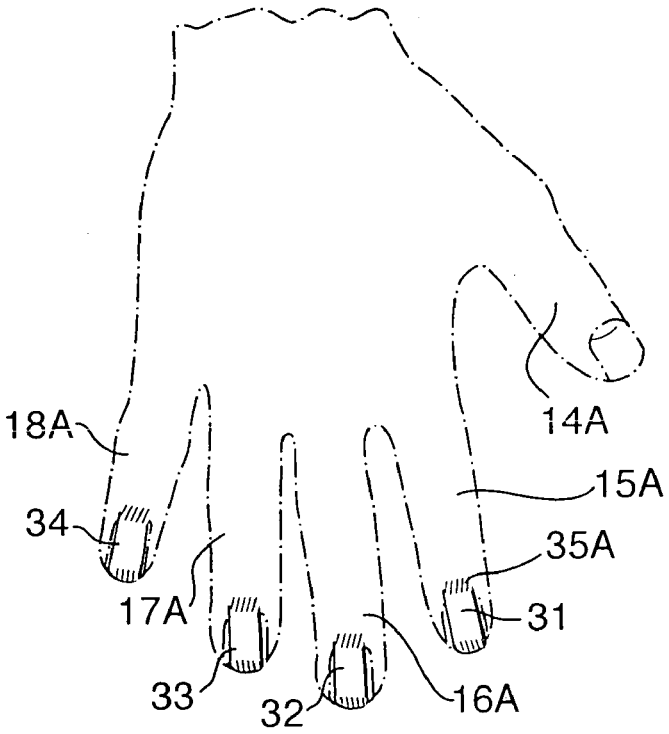
FIG. 9 is a view of the dorsal side of the hand shown in FIG. 8 and illustrating commencement of the finger joint protecting strips.

For sake of clarity FIGS. 5, 8 and 9 shows a hand with the glove omitted except for the elastically stretchable strips. The hand thumb 14A fits of course into the thumb element of the glove and fingers 15A, 16A, 17A and 18A into the glove respective finger elements 15, 16, 17 and 18. In FIGS. 5 and 8 the elastically stretchable strips appear in a position superimposed on the respective fingers as if the hand where inserted into the glove. The ends of the hold downs, in section, are illustrative of the point at which they have been severed from the glove.

Figure 1:
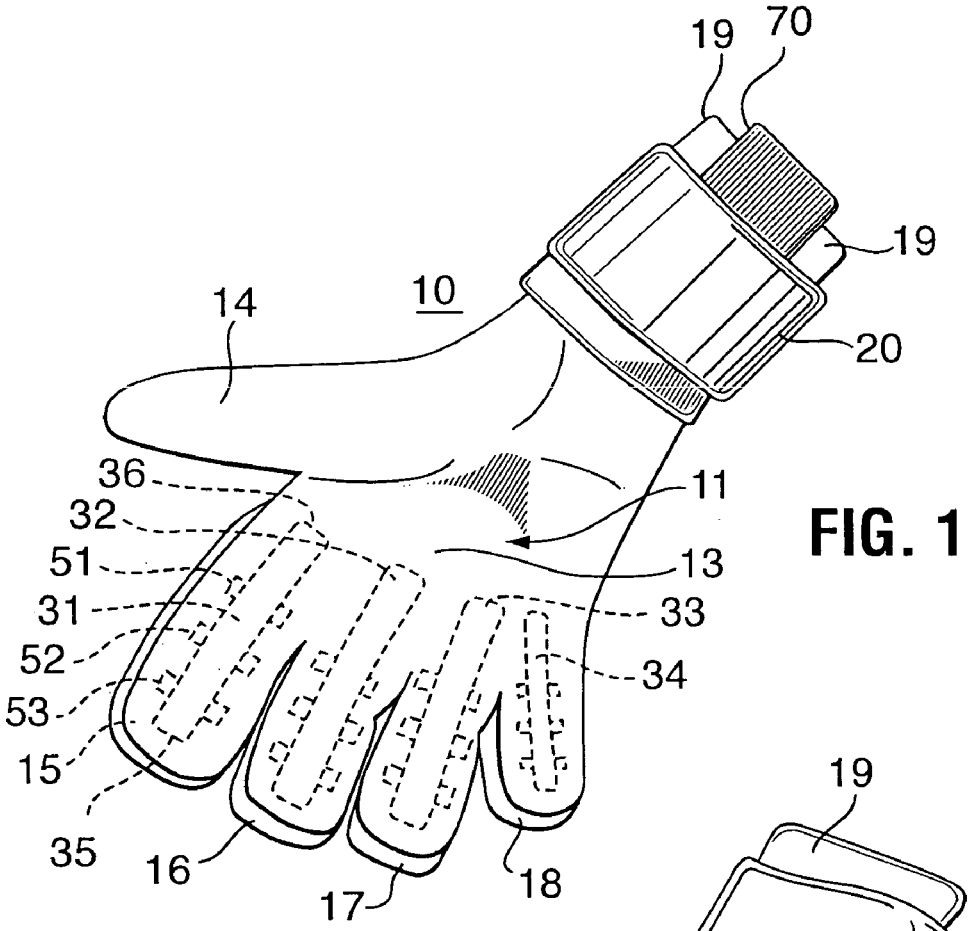
FIG. 1 is an oblique view of a soccer glove taken from the palm face side showing in broken line applicants elasticized strip inserts in the finger elements of the glove.

Referring now to the drawings and particularly FIGS. 1 and 5 the elastic strip 31 is secured at one end thereof as indicated at 35 to the material of the glove finger element 15 covering the distal portion (finger tip) of the second phalanx (index finger 15A) and at the other end as indicated at 36 to the glove palm area 13 covering a portion of the palm 13A of the hand in the glove.

Figure 7:
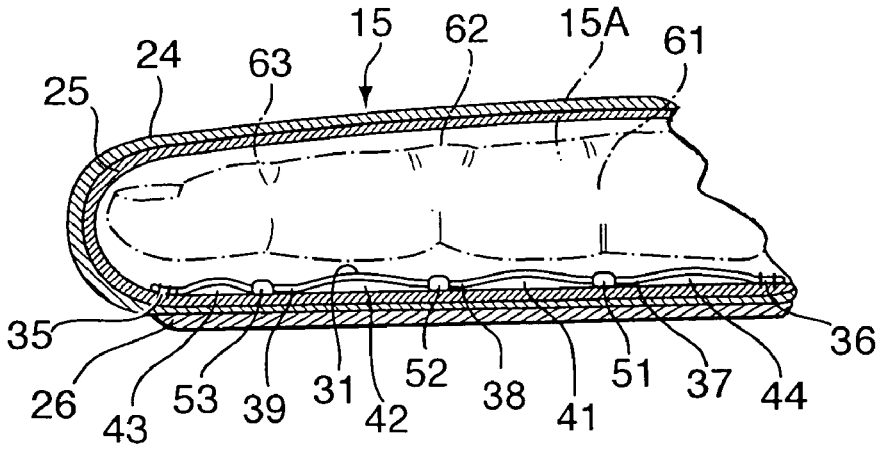
FIG. 7 is a sectional view through a glove finger element taken essentially along line 7—7 in FIG. 2.

The strip 31 passes under strip hold downs 51, 52 located at positions preferably overlying (palm up orientation) respectively the palmer distal crease (PDC) (finger joint 61 of FIG. 7) and the proximal interphalageal crease, (PIC) (finger joint 62 associated therewith in FIG. 7,) of the wearer's hand. A Further strip hold down 53 is shown in FIGS. 1 and 7 located so as to overlie the distal interphalageal crease, (finger joint 63 associated therewith in FIG. 7), of the wearers finger. Further strip hold downs (not shown) maybe located in the palm portion of the glove at positions spaced apart from one another in a direction toward the wrist band depending upon the length of the strips. It is to be clearly understood that the hold downs and the elastically stretchable strips are located within the glove and in the palm side thereof. In the drawings they are shown as being on the palm side of the glove but obviously could be embedded between inner and outer layers of the glove or even on the surface of the glove if so desired.

As previously mentioned the elongate strips preferably have alternate stretchable and non-stretchable portions extending longitudinally along the strip. Referring to FIG. 7, the glove is shown to have an outer layer 24, a lining 25 and padding 26 on the surface of the palm and palm side of the finger elements. A finger 15A is shown, in broken line, in the glove finger element 15. The strip 31 has spaced apart stretchable elasticized portions 37, 38, and 39 is so positioned as to underlie, (palm down orientation as seen in FIG. 7), respective ones of the three finger joints 61, 62, 63 and pass under the hold downs 51, 52, 53 which are attached to the glove. These hold downs are shown underlying respective finger joints 61, 62, and 63. A length portion of the strip between joints has padding portions 41, 42 thereon. Padding 43 on the strip is located under the finger tip portion and padding 44 under the forward end portion of the palm of the users hand. This padding maybe attached to the strip in such a manner as to render that portion of the strip essentially un-stretchable or alternatively the padded sections can form part of the strip and connected one to the next by intervening stretchable elastic, or elasticized, portions to form a continuous strip.

The strip hold downs are shown as loops through which the strip passes. It will be obvious to those skilled in the art that other suitable holds maybe provided.

An elastically stretchable strip 70 (see FIGS. 3, 5) is attached at one end thereof as indicated at 71 within the glove to a portion of the palm of the glove and passes under a hold down 72 then through and out of the wrist band 19 terminating in a free outer end 73. The strip has on a face thereof one portion 74 of a hook and loop fastener that detachably connects to the other portion 75 on the outer surface of the wrist band 19, (palm side of the glove) This strip by way of example maybe about 2 inches wide and is strongly sewn or otherwise securely fastened to the proximal region of the glove. This elasticized strip can be stretched to the desired tension by the user and locked down by the wrist strap 20. This elongate elastically stretchable strip helps in reducing the likelihood of wrist hyper-extension.

A further elongate elastically stretchable strip 80, (see FIG. 5), wraps around the thumb to assist in reducing the likelihood of thumb sprains. This strip is securely fixed at one end thereof, (not shown), to the proximal medial area of the palm running underneath the strip 70. The band 80 extends laterally, (arrow A), and slightly distal towards the thumb crossing over the metacarpal phalanageal joint, (MCP) on the proximal side. The strip then continues around the MCP of the thumb distally and medially. The strip continues to wrap around the MCP, (arrow B), of the thumb going laterally and proximal, (arrow C), eventually emerging through a slot 81 to the outside of the glove on the dorsal side thereof. The portion of the strip disposed external of the glove is identified by ref 82 and has thereon one portion, 83 (see FIGS. 3, 4, 7) of a hook and loop fastener that detachably connects to the other portion 84 of the fastener on the dorsal face of the glove.

Modifications to the joint hyperextension preventing stretchable elasticized strips are illustrated in FIGS. 8 and 9 the first being as mentioned hereinbefore having the strip pass around the end the finger and then anchored to the glove at a position overlying, (palm down orientation), the finger nail. The other modification is having the other end of the strips connected to a strip that passes out through the wrist band that via a hook and loop fastener means attaches to an outer surface of the glove and can be hand pulled by the user before securement to tension the finger strips 31,32 33 and 34 to a desired tension. In the embodiment particularly illustrated in FIG. 8 the strip 80 rather than in the previously described embodiment as being anchored to the glove is connected to the strips 31, 32, 43 and 34 via strips 91 and 92. Strip 91 is attached proximate one end thereof to a free end of the strips 31 and 32 and strip 92 to strips 33, 34. The other end of the strips 91 and 92 is connected to the strip 70.

The strips 91, 92 maybe stretchable elasticized strips connected to a non stretchable strip 70 or vice versa or alternatively all of the strips 91, 92 and 70 maybe elastically stretchable. The purpose is to be able to selectively as desired vary the tension of the strips 31, 32, 33 and 34. The strip 70 further serves the purpose of protecting the wrist from hyper-extension.

As a variation, not shown, the strip 70 could be anchored to the glove as for example illustrated in FIG. 5 in which case the strips 91, 92 could individually or combine as a single strip and pass out via the open wrist band or opening in a wall of the glove to the exterior of the glove and be securable thereto by a hook and loop fastening means.

By way of example each strip 21,32, 33 and 34 may one half inch wide, strips 91, 92 one inch wide and strip 70 two inches wide.

Figure 2:
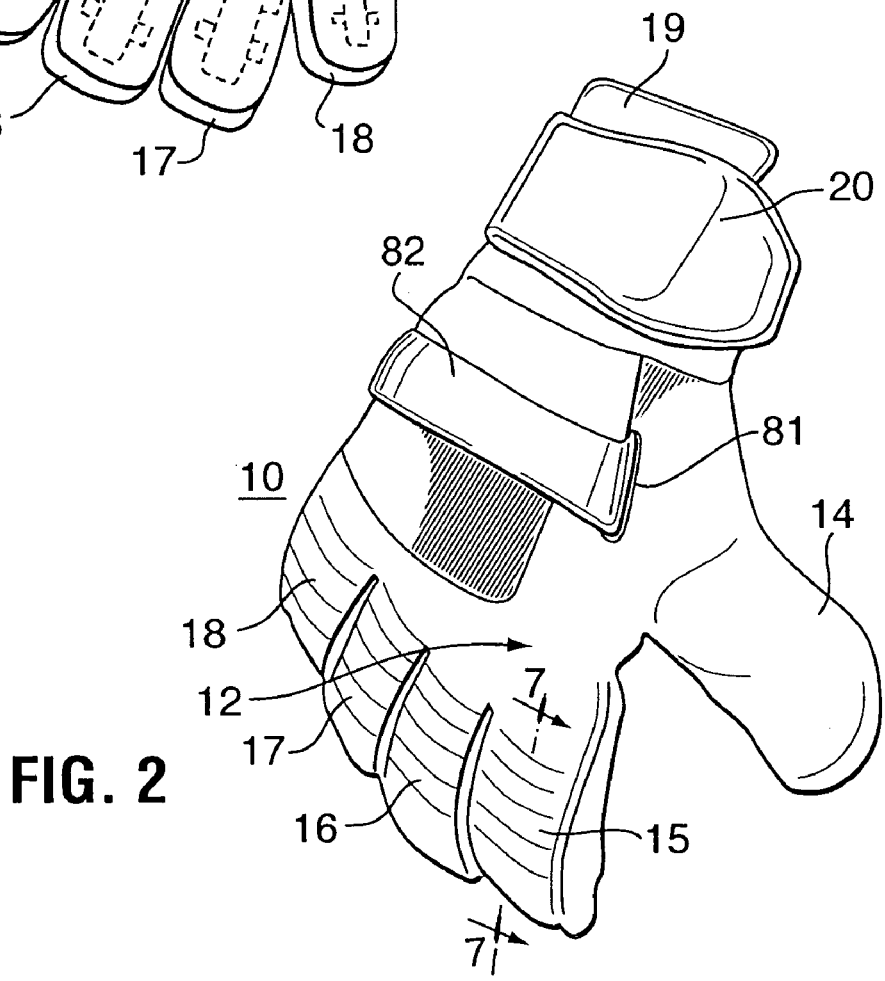
FIG. 2 is an oblique view taken from the dorsal or back face side of the glove.
Figure 3:
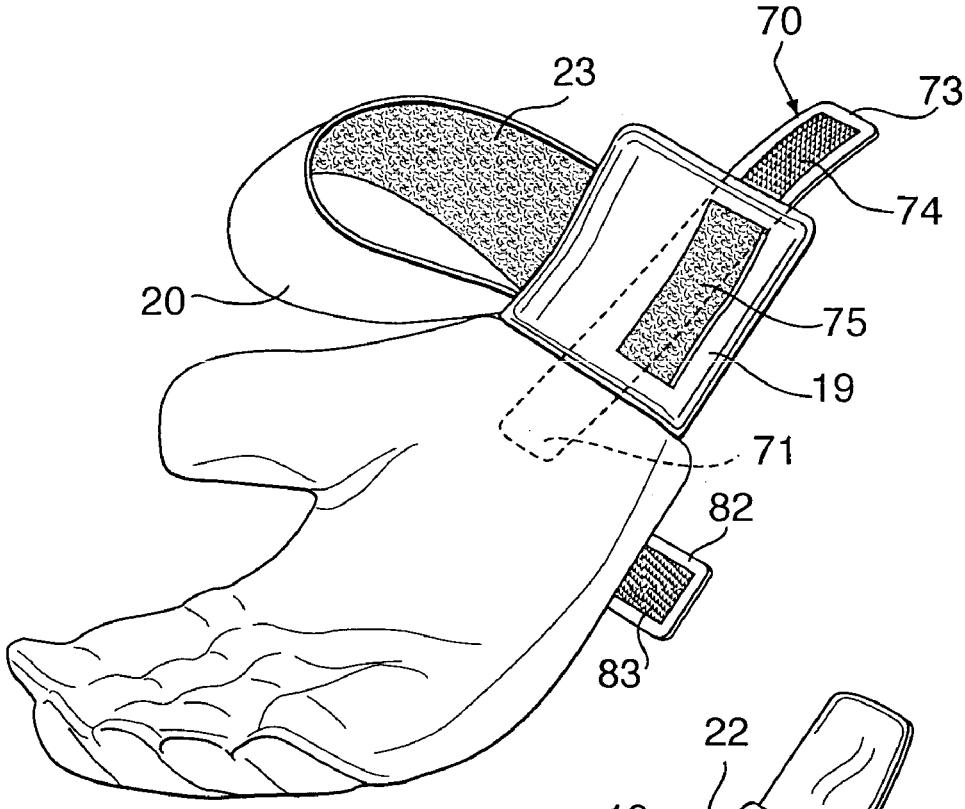
FIG. 3 is similar to FIG. 1 but taken from a different angle showing an elasticized strip in the palm portion of the glove and extending through and beyond the cuff portion of the glove.
Figure 10:
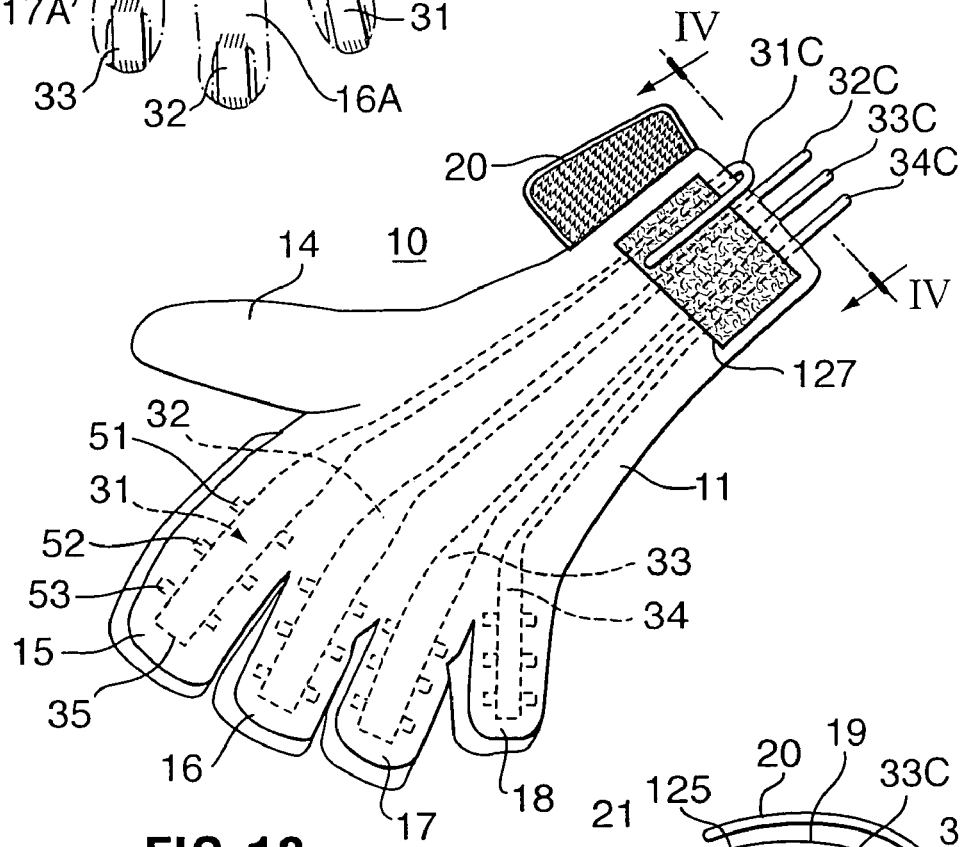
FIG. 10 is a view similar to FIG. 1 illustrating a further modification.
Figure 11:
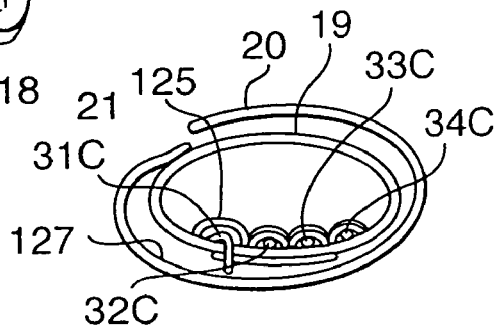
FIG. 11 is a view taken essentially along line 11—11 of FIG. 10.

In the embodiment illustrated in FIG. 8, the stretchable strips in the respective fingers are attached to a single strap that a user of the glove can by pulling on the same selectively vary the tension of the elastically stretchable strips. A further embodiment is illustrated in FIGS. 10 and 11 wherein the tension of the individual finger strips can be varied. Referring to these Figures the elastically stretchable strips 31, 32. 33 and 34 are connected to respective cords 31C, 32C, 33C and 34C. These cords pass through one or more loop type hold downs each of which maybe a single unit 125 with four passages there through for the cords as illustrated or individual loops and then out through the wrist band. An end portion of the respective cords have one portion of a hook and loop fastener thereon that can be brought into engagement with the other portion 127 on the outer surface of the wrist band. In FIG. 10 the cord 31C is shown in a fastened state and it is locked in this fastened state when the wrist strap 20 is tightly wrapped around the wrist band as illustrated in FIG. 2.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A glove having respective oppositely disposed palm and dorsal faces, a wrist band, a plurality of individual finger elements and an elongate elastically stretchable strip anchored at opposite ends thereof respectively to a selected finger element at a first position disposed adjacent the tip of the finger element associated therewith and at a second position on the glove spaced from said first position, said stretchable strip being located on the palm face side of a hand in the glove and tensionable so as to cause the finger element associated therewith to curl the finger element associated therewith in a direction to grip an article when on one's hand; and;

said strip has elasticized portions spaced apart from one another longitudinally along the strip and wherein such portions overlie, in a palm up orientation, selected finger joints and includes hold downs retaining said strips in the finger element associated therewith.

2. The glove as defined in claim 1 wherein said hold downs associated with the respective fingers are discrete members spaced apart from one another longitudinally along the finger element associated therewith.

3. The glove as defined in claim 2 wherein said hold downs are located proximate a finger joint of one wearing the glove.

4. The glove as defined in claim 3 wherein there is a stretchable strip associated with each of the respective finger elements of the glove.

5. A glove having respective oppositely disposed palm and dorsal faces, a wrist band, a plurality of individual finger elements and an elongate elastically stretchable strip anchored at opposite ends thereof respectively to a selected finger element at a first position disposed adjacent the tip of the finger element associated therewith and at a second position on the glove spaced from said first position, said stretchable strip being located on the palm face side of a hand in the glove and tensionable so as to cause the finger element associated therewith to curl the finger element associated therewith in a direction to grip an article when on one's hand;

said strip has elasticized portions spaced apart from one another longitudinally along the strip and wherein such portions overlie, in a palm up orientation, selected finger joints and includes hold downs retaining said strips in the finger element associated therewith; and said hold downs associated with the respective fingers are discrete members spaced apart from one another longitudinally along the finger element associated therewith.

6. The glove as defined in claim 5 wherein said hold downs are located proximate a finger joint of one wearing the glove.

7. The glove as defined in claim 6 wherein there is a stretchable strip associated with each of the respective finger elements of the glove.

8. A glove having respective oppositely disposed palm and dorsal faces, a wrist band, a plurality of individual finger elements and an elongate elastically stretchable strip anchored at opposite ends thereof respectively to a selected finger element at a first position disposed adjacent the tip of the finger element associated therewith and at a second position on the glove spaced from said first position, said stretchable strip being located on the palm face side of a hand in the glove and tensionable so as to cause the finger element associated therewith to curl the finger element associated therewith in a direction to grip an article when on one's hand;

said strip has elasticized portions spaced apart from one another longitudinally along the strip and wherein such portions overlie, in a palm up orientation, selected finger joints and includes hold downs retaining said strips in the finger element associated therewith;

said hold downs associated with the respective fingers are discrete members spaced apart from one another longitudinally along the finger element associated therewith; and said hold downs are located proximate a finger joint of one wearing the glove.

9. The glove as defined in claim 8 wherein there is a stretchable strip associated with each of the respective finger elements of the glove.

10. A glove having respective oppositely disposed palm and dorsal faces, a wrist band, a plurality of individual finger elements and an elongate elastically stretchable strip anchored at opposite ends thereof respectively to a selected finger element at a first position disposed adjacent the tip of the finger element associated therewith and at a second position on the glove spaced from said first position, said stretchable strip being located on the palm face side of a hand in the glove and tensionable so as to cause the finger element associated therewith to curl the finger element associated therewith in a direction to grip an article when on one's hand;

said strip has elasticized portions spaced apart from one another longitudinally along the strip and wherein such portions overlie, in a palm up orientation, selected finger joints and includes hold downs retaining said strips in the finger element associated therewith;

said hold downs associated with the respective fingers are discrete members spaced apart from one another longitudinally along the finger element associated therewith;

said hold downs are located proximate a finger joint of one wearing the glove; and a stretchable strip is associated with each of the respective finger elements of the glove.

11. A hand glove for the participant of an active sport in which at least one finger of that participant subjected to hyper-extension while participating in the sport, said glove having oppositely disposed respective palm and dorsal faces and a plurality of individual finger elements, an elongate strip of material secured to the glove and located on the palm side of a hand inserted into the glove for each one of selected finger elements of the glove, each said strip being anchored at one end thereof proximate the tip of the glove finger element associated therewith and at the other end proximate the palm portion of the glove;

wherein each said strip has at least selected portions spaced longitudinally there along that are elastically stretchable, and wherein the strips are tensioned causing the glove finger element associated with the strip to curl, in an at rest state, in the direction of an article gripping position; and wherein portions of said strip disposed between said elastically stretchable portions are, relative thereto, essentially un-stretchable.

12. The glove as defined in claim 11 including padding on said un-stretchable portions.

13. The glove as defined in claim 12 wherein said padding is secured to the strip rendering the portion of the strip associated therewith un-stretchable.

14. The glove as defined in claim 11 including strip hold downs retaining in position respective ones of said strips.

15. The glove as defined in claim 14 wherein said strip hold downs are discrete members spaced apart from one another longitudinally along respective ones of said strips.

16. The glove as defined in claim 15 wherein said hold downs are located proximate a finger joint of one hand in the glove.

17. The glove as defined in claim 11 including a further elongate strip of elastically stretchable material secured proximate one end thereof to a palm portion of the glove at a position overlying the palm side of said hand, said further elongate strip passing out through to the outer surface of said glove and terminating in a free outer end portion disposed exteriorly of said glove with means detachably securing the same to an outer surface portion of said glove.

18. A hand glove for the participant of an active sport in which at least one finger of that participant subjected to hyper-extension while participating in the sport, said glove having oppositely disposed respective palm and dorsal faces and a plurality of individual finger elements, an elongate strip of material secured to the glove and located on the palm side of a hand inserted into the glove for each one of selected finger elements of the glove, each said strip being anchored at one end thereof proximate the tip of the glove finger element associated therewith and at the other end proximate the palm portion of the glove;

each of said strip has at least selected portions spaced longitudinally there along that are elastically stretchable, and wherein the strips are tensioned causing the glove finger element associated with the strip to curl, in an at rest state, in the direction of an article gripping position;

wherein portions of said strip disposed between said elastically stretchable portions are, relative thereto, essentially un-stretchable; and including padding on said un-stretchable portions.

19. The glove as defined in claim 18 wherein said padding is secured to the strip rendering the portion of the strip associated therewith un-stretchable.

20. The glove as defined in claim 18 including strip hold downs retaining in position respective ones of said strips.

21. The glove as defined in claim 20 wherein said strip hold downs are discrete members spaced apart from one another longitudinally along respective ones of said strips.

22. The glove as defined in claim 21 wherein said hold downs are located proximate a finger joint of one hand in the glove.

23. The glove as defined in claim 18 including a further elongate strip of elastically stretchable material secured proximate one end thereof to a palm portion of the glove at a position overlying the palm side of said hand, said further elongate strip passing out through to the outer surface of said glove and terminating in a free outer end portion disposed exteriorly of said glove with means detachably securing the same to an outer surface portion of said glove.

24. A hand glove for the participant of an active sport in which at least one finger of that participant subjected to hyper-extension while participating in the sport, said glove having oppositely disposed respective palm and dorsal faces and a plurality of individual finger elements, an elongate strip of material secured to the glove and located on the palm side of a hand inserted into the glove for each one of selected finger elements of the glove, each said strip being anchored at one end thereof proximate the tip of the glove finger element associated therewith and at the other end proximate the palm portion of the glove;

wherein each said strip has at least selected portions spaced longitudinally there along that are elastically stretchable, and wherein the strips are tensioned causing the glove finger element associated with the strip to curl, in an at rest state, in the direction of an article gripping position; and said padding is secured to the strip rendering the portion of the strip associated therewith un-stretchable.

25. The glove as defined in claim 24 wherein portions of said strip disposed between said elastically stretchable portions are, relative thereto, essentially un-stretchable.

26. The glove as defined in claim 25 including padding on said un-stretchable portions.

27. The glove as defined in claim 24 including strip hold downs retaining in position respective ones of said strips.

28. The glove as defined in claim 27 wherein said strip hold downs are discrete members spaced apart from one another longitudinally along respective ones of said strips.

29. The glove as defined in claim 28 wherein said hold downs are located proximate a finger joint of one hand in the glove.

30. The glove as defined in claim 24 including a further elongate strip of elastically stretchable material secured proximate one end thereof to a palm portion of the glove at a position overlying the palm side of said hand, said further elongate strip passing out through to the outer surface of said glove and terminating in a free outer end portion disposed exteriorly of said glove with means detachably securing the same to an outer surface portion of said glove.

31. A hand glove for the participant of an active sport in which at least one finger of that participant subjected to hyper-extension while participating in the sport, said glove having oppositely disposed respective palm and dorsal faces and a plurality of individual finger elements, an elongate strip of material secured to the glove and located on the palm side of a hand inserted into the glove for each one of selected finger elements of the glove, each said strip being anchored at one end thereof proximate the tip of the glove finger element associated therewith and at the other end proximate the palm portion of the glove;

including strip hold downs retaining in position respective ones of said strips; and said hold downs are discrete members spaced apart from one another longitudinally along respective ones of said strips.

32. The glove as defined in claim 31 wherein said hold downs are located proximate a finger joint of one hand in the glove.

33. A hand glove for the participant of an active sport in which at least one finger of that participant subjected to hyper-extension while participating in the sport, said glove having oppositely disposed respective palm and dorsal faces and a plurality of individual finger elements, an elongate strip of material secured to the glove and located on the palm side of a hand inserted into the glove for each one of selected finger elements of the glove, each said strip being anchored at one end thereof proximate the tip of the glove finger element associated therewith and at the other end proximate the palm portion of the glove;

including strip hold downs retaining in position respective ones of said strips;

said hold downs are discrete members spaced apart from one another longitudinally along respective ones of said strips; and said hold downs are located proximate a finger joint of one hand in the glove.

* * * * *